US007878730B2

(12) United States Patent
Weaver

(10) Patent No.: US 7,878,730 B2
(45) Date of Patent: Feb. 1, 2011

(54) BAR COUPLING APPARATUS AND METHODS

(76) Inventor: Jason M. Weaver, 40 Valley Rd., Edgewood, NM (US) 87015

( * ) Notice: Subject to any disclaimer, the term of this patent is extended or adjusted under 35 U.S.C. 154(b) by 0 days.

(21) Appl. No.: 12/397,933

(22) Filed: Mar. 4, 2009

(65) Prior Publication Data

US 2009/0180828 A1 Jul. 16, 2009

Related U.S. Application Data

(63) Continuation of application No. PCT/US2009/031306, filed on Jan. 16, 2009.

(60) Provisional application No. 61/021,505, filed on Jan. 16, 2008.

(51) Int. Cl.
*E04C 5/16* (2006.01)

(52) U.S. Cl. ..... 403/305; 403/293

(58) Field of Classification Search ..... 52/719; 403/268, 293, 305

See application file for complete search history.

(56) References Cited

U.S. PATENT DOCUMENTS

| | | | | | |
|---|---|---|---|---|---|
| 50,190 | A | | 9/1865 | Matson | |
| 1,238,994 | A | | 9/1917 | Erikson | |
| 3,006,983 | A | * | 10/1961 | McDurmont | 174/94 R |
| 3,540,763 | A | * | 11/1970 | Yee | 403/265 |
| 3,638,978 | A | | 2/1972 | Gunterman | |
| 3,756,635 | A | * | 9/1973 | Beers | 312/111 |
| 3,952,468 | A | | 4/1976 | Soum | |
| 4,024,688 | A | | 5/1977 | Calini | |
| 4,081,219 | A | | 3/1978 | Dykmans | |
| 4,095,389 | A | | 6/1978 | Outram et al. | |
| 4,241,490 | A | * | 12/1980 | Edwards | 29/459 |
| 4,314,771 | A | * | 2/1982 | Lambert | 403/305 |
| 4,424,867 | A | | 1/1984 | Mallow | |
| 4,627,212 | A | * | 12/1986 | Yee | 52/848 |
| 4,752,151 | A | * | 6/1988 | Ashida et al. | 403/267 |
| 4,850,777 | A | | 7/1989 | Lawrence et al. | |
| 4,919,560 | A | * | 4/1990 | Rutledge et al. | 403/268 |
| 5,046,878 | A | * | 9/1991 | Young | 403/13 |

(Continued)

OTHER PUBLICATIONS

Dayton Superior, Concrete Accesories, www.daytonconcreteacc.com/Rebar-Splicing, 4 pages printed Aug. 01, 2008.

(Continued)

*Primary Examiner*—Joshua T Kennedy
(74) *Attorney, Agent, or Firm*—Santangelo Law Offices

(57) ABSTRACT

Particular embodiments of the inventive technology relate to a device for connecting the ends of two concrete reinforcing bars in which a metal sleeve has chambers at each end to accommodate the end of one reinforcing bar. Forces may be transferred from one bar to the other through, the use of, inter alia, an adhesive established within the space between the outside of the reinforcing bars and the deformed inner surface of the sleeve. The chambers are, preferably, separated by a fluid impervious barrier. One port associated with each chamber may be established to allow fluid such as air to escape, preventing air voids in the adhesive. Another configuration of the inventive device would be intended for the retention (under load, of course) of only one reinforcing bar, with an enlarged flange for anchoring the end of one reinforcing bar, perhaps at and outer surface of, e.g., a concrete slab.

11 Claims, 6 Drawing Sheets

U.S. PATENT DOCUMENTS

| | | | | | |
|---|---|---|---|---|---|
| 5,152,118 | A | * | 10/1992 | Lancelot | 52/848 |
| 5,305,573 | A | | 4/1994 | Baumann | |
| 5,308,184 | A | | 5/1994 | Bernard | |
| 5,366,672 | A | | 11/1994 | Albrigo et al. | |
| 5,383,740 | A | * | 1/1995 | Lancelot, III | 403/267 |
| 5,459,973 | A | | 10/1995 | Baumann | |
| 5,561,956 | A | | 10/1996 | Englekirk et al. | |
| 5,606,839 | A | | 3/1997 | Baumann | |
| 5,729,952 | A | | 3/1998 | Dahl | |
| 5,732,525 | A | | 3/1998 | Mochizuki | |
| 5,967,691 | A | | 10/1999 | Lancelot | |
| 5,971,669 | A | | 10/1999 | Crigler | |
| 6,065,263 | A | | 5/2000 | Taguchi | |
| 6,089,779 | A | | 7/2000 | Lancelot | |
| 6,099,196 | A | | 8/2000 | Lancelot | |
| 6,192,647 | B1 | | 2/2001 | Dahl | |
| 6,328,499 | B1 | | 12/2001 | Reding et al. | |
| 6,571,528 | B1 | | 6/2003 | Crump | |
| 6,622,442 | B2 | | 9/2003 | Kwon | |
| 6,631,592 | B1 | | 10/2003 | Hancock | |
| 6,679,024 | B2 | | 1/2004 | Dahl | |
| 6,773,198 | B2 | | 8/2004 | Copping | |
| 6,814,525 | B1 | | 11/2004 | Whitsett | |
| 6,843,031 | B1 | | 1/2005 | Sorkin | |
| 6,925,773 | B2 | * | 8/2005 | Gregel et al. | 403/265 |
| 7,112,012 | B2 | | 9/2006 | Whitsett | |
| 2003/0198513 | A1 | * | 10/2003 | Wang | 403/362 |
| 2007/0175167 | A1 | * | 8/2007 | Allen et al. | 52/726.1 |
| 2008/0060291 | A1 | * | 3/2008 | Braun | 52/223.2 |

OTHER PUBLICATIONS

Dayton Superior, Concrete Accessories, www.daytonconcreteacc.com; DS Concrete Accessories, Grouted Steve, Grouted Splicing D-119, printed Aug. 6, 2009, 2 pages.

Dayton Superior Concrete Accessories, www.daytonconcreteacc.com, Bar-Lock Lockshear Bolt System—DS Bar-Lock Coupler System, printed Aug. 6, 2008, 1 page.

DYWIDAG-System International; www.dsiamerica.com/products/reinforcing/threadbar-system/system-description.html; DYWIDAG Threadbar Reinforcing Systems, brochure, printed May 8, 2007, 4 pages.

NMB Splice Sleeve Systems, www.splices.com; Dec. 17, 2007, 3 pages.

Erico, Cadweld Rebar; www.erico.com/products/cadweldrebar.asp; May 7, 2007; 4 pages.

BarSplice Productions, Inc., Zap Screwlok Mechanical Splices, www.barsplice.com/zapscrewlok_system.html, Apr. 25, 2007.

BarSplice Productions, Inc., BarGrip, www.barsplice.com/bargrip_system.html, Apr. 25, 2007.

BarSplice Productions, Inc., BarSplicer, www.barsplice.com/barsplicer_system.html.

BarSplice Productions, Inc., GripTwist, www.barsplice.com/griptwist_system.html, Apr. 25, 2007.

Williams Form Engineering Corp., www.williamsform.com/Concrete_Forming_Hardware/pdfs/fh3031.pdf; Apr. 25, 2007.

Dayton/Richmond Concrete Accessories, Bar-Lock Coupler System, www.barlock.com, Jun. 1, 2007.

International Patent Application No. PCT/US09/31306, International Search Report dated Mar. 9, 2009.

International Patent Application No. PCT/US09/31306, Written Opinion of the International Searching Authority dated Mar. 9, 2009.

* cited by examiner

BAR COUPLING APPARATUS AND METHODS

CROSS REFERENCES TO RELATED APPLICATIONS

This application is a continuation of prior International Patent Application Number PCT/US2009/031306, filed Jan. 16, 2009, said international application hereby incorporated herein in its entirety and itself claiming benefit of and priority to U.S. Provisional Patent Application No. 61/021,505, filed 16 Jan., 2008, said provisional application also incorporated herein in its entirety.

BACKGROUND OF THE INVENTION

Generally, the inventive technology relates to the field of bar retention. More specifically, the inventive technology, in embodiments, relates to bar coupling sleeve apparatus (e.g., rebar coupling sleeve apparatus), bar end portion retainer apparatus and bar retention methods that may find particular application in, e.g., the reinforced structure construction industry.

BACKGROUND ART

In reinforced concrete construction, including buildings, bridges, and other structures, reinforcing steel (e.g., rebar) is used to resist tensile and shear stresses. Since the concrete is relatively inefficient in resisting or withstanding such stresses, reinforcing steel is added where these stresses occur in a structure to significantly increase the overall strength of the structure. In addition to adding strength to a structure, reinforcing steel also enhances the ductility of the structure. In other words, it increases the structure's ability to absorb energy, which is a desirable characteristic for any structure that may be subject to, e.g., seismic forces.

In many structures, for the reinforcing steel to be effective, the reinforcing steel must "continuously" extend for a certain length, meaning that it must not have any discontinuities at any point along that given length. If this length is greater than the length of a bar that can reasonably be placed into position, the reinforcing steel bar must be "spliced" (or connected end-to-end) with another length of reinforcing steel bar. Typically, this splice is created by lapping the two reinforcing bars creating a "lap splice." The length of the overlap of the lap splice is governed by commonly accepted codes and standards and depends on numerous factors including, but not limited to, reinforcing bar diameter, grade of reinforcing bar, compressive strength of concrete, concrete cover. The most common standard in the US, from which many codes are formed, is "Building Code Requirements for Structural Concrete" by the American Concrete Institute (ACI), more commonly know as ACI 318. ACI 318 provides for three types of splices—lap splices, mechanical splices, and welded splices. ACI 318 requires mechanical and welded splices—in addition to lap splices—to be capable of withstanding, in tension or compression, a design force such as 125% of the force that would cause a stress equal to the yield strength of the spliced reinforcing bar. The device of the inventive technology falls into the category of a mechanical splice; it must have a design strength such that it can withstand, without failure, 125% of the yield strength of the reinforcing bar.

Another common occurrence in concrete construction is the need to terminate a reinforcing bar at a specific location in or at the end of the structure. Often the entire strength of the reinforcing bar is required a short distance from the end of the bar. However, because forces are transferred from the reinforcing bar to the concrete primarily by the mechanical keying of the reinforcing bar deformations, a certain length of bar, and therefore a certain number of deformations, is required to develop the full strength of the bar. ACI 318 refers to the length as the "development length" of the bar. When the development length of the bar exceeds the distance from the end of the bar to the point where the full strength of the bar is required, special provisions must be employed to shorten the development length of the bar. Typically, this is done by creating a bend, or hook, in the reinforcing bar. Another viable option is to use a mechanical anchor, which is typically flanged to engage more concrete and which can develop 125% of the capacity of the bar at a point where such strength is needed. Without such provisions, adequate strengths are not observed at all locations needed. Particular embodiments of the inventive technology, such as those depicted in FIG. 2, are able to provide code strengths (design strength) at such "terminal" locations.

BRIEF SUMMARY OF THE INVENTION

Preferred embodiments of the inventive technology provide a device—a contiguity—may, in embodiments, be described as a simple high-strength steel sleeve with holes at each end and that continue towards the longitudinal center of the cylinder, defining chambers. The inner surface of the chambers can be deformed (in at least one embodiment, they may be concentrically deformed, in another, helically deformed). In preferred embodiments, the smallest diameter of the chambers, occurring at the top of the deformations (e.g., the most intra-radial portion of the deformations), may be slightly larger than the diameter of the reinforcing bar. An adhesive (a non-cementitious material) may be placed into one of the holes and, thereafter, the reinforcing bar may be inserted into the hole, thereby forcing the adhesive into the valleys formed by the deformations of the device. As is the case with other reinforcement splices, two important functionalities of the inventive technology are the transfer of tensile forces from one deformed reinforcing bar to the other, and the transfer of compressive forces from one deformed reinforcing bar to the other.

In embodiments with deformations of the inner surface of the contiguity, such deformations may serve several functions. First, the deformations (in particular their size relative to the reinforcing bar and the gap formed thereby) may be sized to provide passages through which the adhesive can flow to surround the entire reinforcing bar. Such, as an ancillary functionality, increases the surface area of the bar that is in contact with the adhesive, allowing more bonding between the adhesive and the reinforcing bar. Additionally, the deformations provide a mechanical anchorage for the adhesive. The deformations mechanically engage the adhesive to resist the tendency of the adhesive to be withdrawn from the device when a tension force is applied to the reinforcing bar. As should be understood, in particular embodiments of the inventive technology, deformations on the inner surface of the holes aid in force transfer through wedging action on the cured adhesive. It is also of note that no special tools are required for installation and that no special treatment of the deformed reinforcing bars is required for installation.

DETAILED DESCRIPTION OF THE INVENTION

Figure 1:
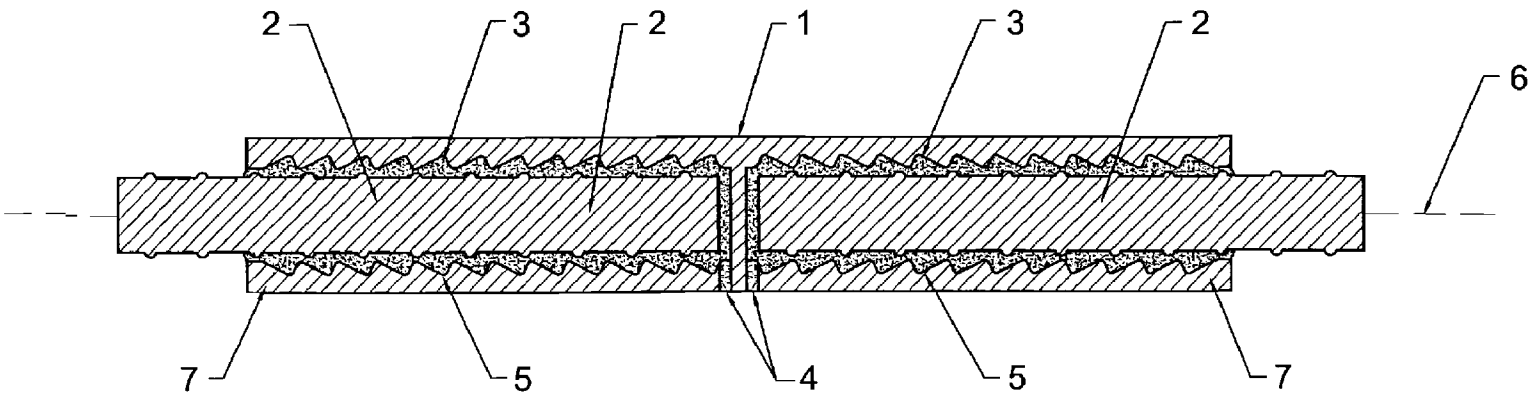
FIG. 1 shows a cross-sectional view of at least one embodiment of the inventive technology.
Figure 2:
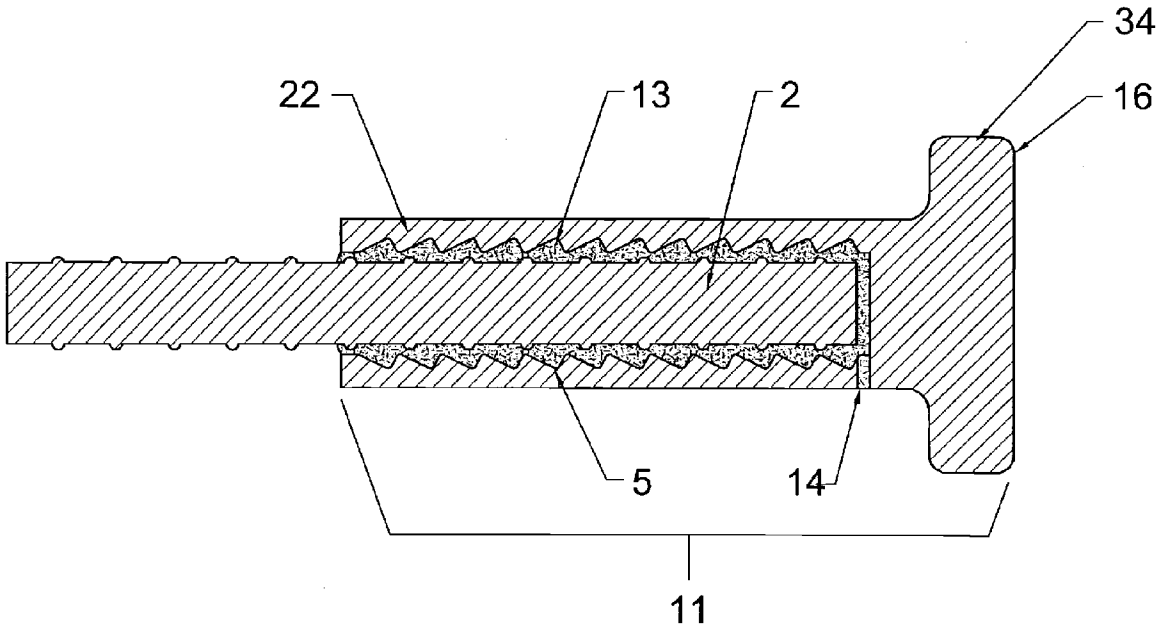
FIG. 2 shows a cross-sectional view of at least one embodiment of the inventive technology usable at the end of a concrete structure.
Figure 3:
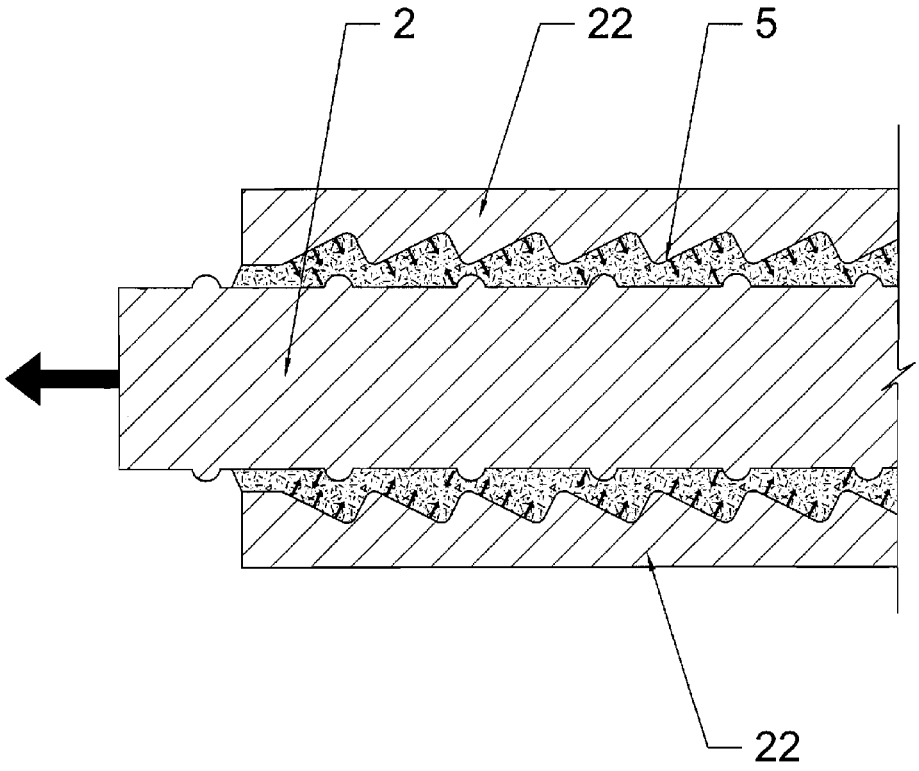
FIG. 3 shows a cross-sectional view of at least one embodiment of the inventive technology, in particular showing the forces observed in response to a tensile force applied to the bar, where such forces are applied by the deformations on the outside of reinforcing bar established inside the coupler, through cured adhesive to the deformations on the inside of an inventive coupler.
Figure 4A:
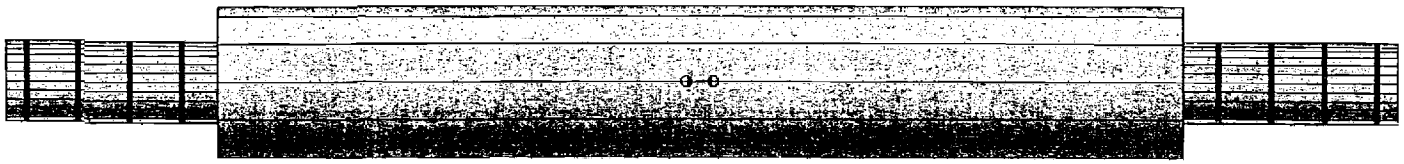
FIG. 4A shows a side view of at least one embodiment of the inventive technology in use coupling two bars.
Figure 4B:
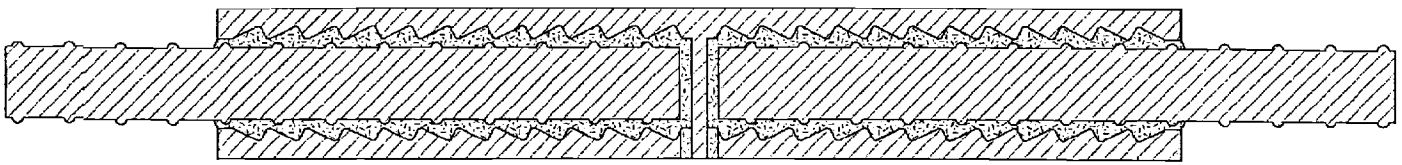
FIG. 4B shows a cross-sectional side view of at least one embodiment of the inventive technology in use coupling two bars.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

At least one embodiment of the inventive technology may be described as a bar coupling sleeve apparatus that comprises: a rigid contiguity 1 defining a longitudinal axis 6, and having two ends 7 and an opening 9 at each the ends for reception of bar end portions (e.g., rebar end portions); a fluid impervious barrier 8 (through which, of course, fluid cannot pass) established as part of the contiguity to define an end of each of two fluidically non-communicative chambers 10 within the contiguity, each of the chambers sized to accommodate a different one of the bar end portions and a curable wet fluid (e.g., adhesive) 3; and two fluid outlet ports 4, each associated with a different one of the chambers, and each enabling fluidic communication (the passage of a fluid such as air or adhesive) between its associated chamber and an environment external 20 of the contiguity. As in certain other embodiments, each of the two fluid outlet ports may enable fluidic communication between the environment and a barrier proximal end portion 21 of its associated chamber. Further, the curable wet fluid (e.g., adhesive such as epoxy), upon curing, retains the bar end portions in a different one of the chambers. Of course, fluid can not directly pass from one fluidically non-communicative chamber to the other (a theoretically possible passage of air from one chamber, out its associated fluid outlet port, out to the environment external of the contiguity, and then through a fluid port associated with a different chamber is not considered a type of fluidic communication that the term "fluidically non-communicative" excludes; the term primarily excludes any sort of fluid port through a barrier between the two chambers).

At least one embodiment of the inventive technology may be described as a bar coupling sleeve apparatus that comprises: a rigid contiguity 1 defining a longitudinal axis 6 and two fluidically non-communicative chambers 10, each having an opening 9 for non-contact reception of an end portion 2 of bar of a design size; a fluid impervious barrier 8 established as part of the contiguity to define an end of each of the two fluidically non-communicative chambers; and deformations 5 established on interior walls 22 that at least partially define the chambers (perhaps it is also defined by walls of a fluid impervious barrier), wherein the interior walls and the deformations are sized so that the end portions of the bar of design size may be established within the chambers without contacting the deformations. A bar of design size is the bar for which a coupling apparatus is intended; in certain embodiments, the interior surface of such apparatus may allow for a clearance of from 1 mm to 10 mm (as one exemplary, but preferred, range) between the bar and the deformations. Of course, merely because a bar may be established within the chambers without contacting the deformations does not mean that, during field insertion of a bar end into a chamber of the apparatus, there will definitely not be contact; it merely means that such absence of contact is possible, and that fluidic clearance between the bar and the inner walls exists.

At least one embodiment of the inventive technology may be described as a bar coupling sleeve apparatus that comprises: a rigid contiguity 1 defining a longitudinal axis 6, and having two ends 7 and openings 9 at each of the ends for reception of bar end portions; at least one fluid outlet port 4, each enabling fluidic communication between an environment 20 external of the contiguity and one of two chambers 10, each of which is at least partially defined by interior walls 22 of the contiguity; and deformations 5 established on the interior walls 22, wherein the each fluid outlet port 4 is established substantially at a closed end (e.g., a barrier proximal end 21) of a different one of the chambers. It is of note that the apparatus, in particular embodiments, has a total of two chambers; such chambers may be fluidically non-communicative. The apparatus may further comprise a fluid impervious barrier 8 established as part of the contiguity to define an end of each of the two fluidically non-communicative chambers. It is also of note that, particularly in the two chamber embodiments, the at least one fluid outlet port may comprise at least two fluid outlet ports, each established substantially at a longitudinal midpoint of the rigid contiguity and each enabling fluidic communication between an environment external of the contiguity and a chamber at least partially defined by interior walls of the contiguity. It is of note that the term "substantially at a longitudinal midpoint of the rigid contiguity" includes up to a ¼ length portion centered at the midpoint.

At least one embodiment of the inventive technology may be described as a bar coupling sleeve apparatus that comprises: a rigid contiguity 1 defining a longitudinal axis 6 and having two ends 7 and openings 9 at both the ends for reception of bar end portions 2; and a fluid impervious barrier 8 established as part of the contiguity to define an end of each of two fluidically non-communicative chambers 10 within the contiguity, each of the chambers sized to accommodate a different one of the bar end portions. As in other embodiments, each of the chambers is sized to also accommodate a curable wet fluid (e.g., adhesive such as epoxy). The apparatus may further comprise two fluid outlet ports 4, each associated with a different one of the chambers, and each enabling fluidic communication between its associated chamber and an environment external of the contiguity. Each of such two fluid outlet ports may enable fluidic communication between an environment external of the contiguity and a barrier proximal end portion of its associated chamber.

At least one embodiment of the inventive technology, more particularly focusing on the single bar retention apparatus, may be described as a bar end portion retainer apparatus that comprises: a rigid contiguity 11 defining a chamber 30 that has an opening 39 at a first end of the contiguity for reception of a bar end portion 2; a flange 16 established at a second end 34 of the rigid contiguity; and a fluid outlet port 14 enabling fluidic communication between the chamber 30 and an environment 20 external of the contiguity. In particular embodiments, the fluid outlet port is established proximal a terminal end 35 of the chamber 30.

At least one embodiment of the inventive technology, more particularly focusing on the single bar retention apparatus, may be described as a bar end portion retainer apparatus that comprises: a rigid contiguity 11 defining a chamber 30 that has an opening 39 at a first end 40 of the contiguity for reception of a bar end portion 22; a flange 16 established at a second end 34 of the rigid contiguity; and deformations 15 established on interior walls 22 that at least partially define the chamber. The apparatus may further comprise a fluid outlet port 14 enabling fluidic communication between the chamber and an environment external of the contiguity 20; such fluid outlet port may be established proximal a terminal end of the chamber 35. As with other embodiments, interior walls and the deformations may be sized so that a bar end portion of design size may be established within the chambers without contacting the deformations.

Figure 6A:
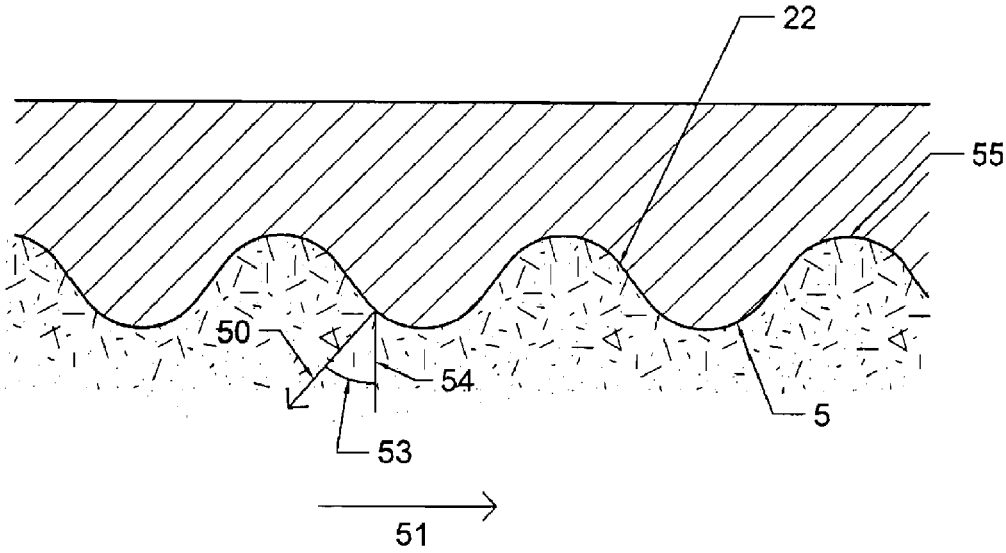
FIG. 6A shows a cross-sectional side view of a portion of the single or two bar apparatus, showing deformations as may be found in certain embodiments of the inventive technology. Of course, a myriad of other possible deformations may be used.
Figure 6B:
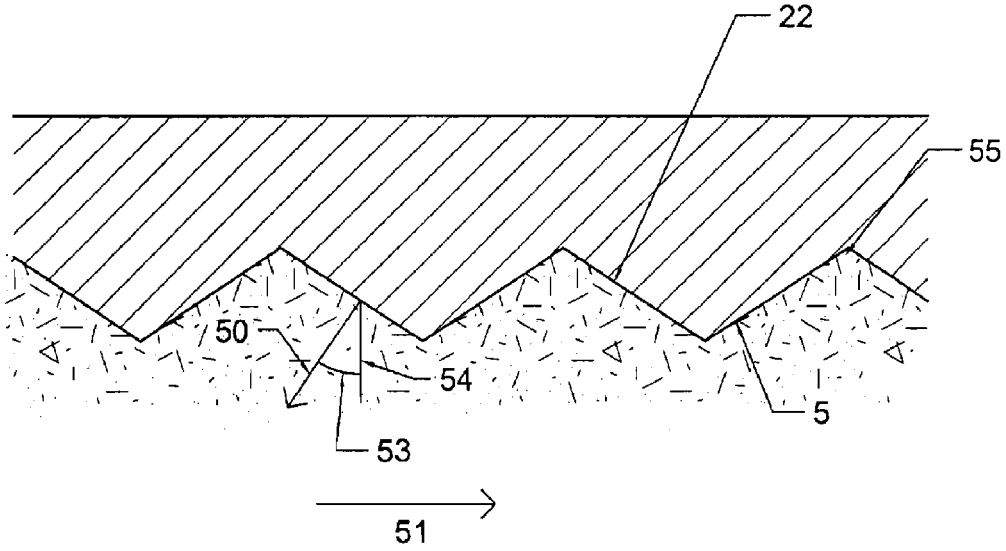
FIG. 6B shows a cross-sectional side view of a portion of the single or two bar apparatus, showing deformations as may be found in certain embodiments of the inventive technology.

Of course, in any of the embodiments disclosed herein deformations may be established on interior walls 22 that at least partially define the chambers. Interior walls and the deformations are typically (but not necessarily always) sized so that the end portions of the bar of design size may be established within the chambers without contacting the deformations. A cross-section of the deformations in a plane that is parallel to the longitudinal axis (see FIGS. 6A and 6B) may show a pattern having at least one section that defines a normal vector 50 that (a) has a component that is opposite to a bar withdrawal direction 51; and that (b) is at least 20 degrees (see angle 53) relative to a plane 54 that is orthogonal to the longitudinal axis. Such at least one section (that defines a normal vector with a component having limitations (a) and (b)) may be either curved (see, e.g., FIG. 6A) or linear (see, e.g., FIG. 6B). The at least one section may define at least one valley 55, and the at least one section may be repeated. It is of note that even if the entire vector is in a certain direction, that it is still said that such vector has a component in that certain direction. Deformations can be made in a number of known ways, including but not limited to mechanical stress induced deformations, material addition (material addition is considered a type of deformation). Further, deformations can be of a myriad of shapes; shown in the figures are only a few examples. It is also of note that even a chamber having a substantially circular cross-section (whether with deformations or without) is viewed as having walls (plural).

In certain preferred embodiments, insertion of adhesive 3 (e.g., epoxy) into the chambers, and subsequent insertion of the bar end portions into the chamber, results in a design strength coupling after curing. In preferred embodiments, the adhesive is insertable into the chambers without pressure (application of a caulking gun is not considered a pressurized insertion, as the adhesive, after exiting the gun and while being deposited into the chamber, is not under pressure). It is of note that, in preferred embodiments, design strength is achievable without heat application or welding.

In certain embodiments having fluid outlet ports, the apparatus may be the to be configured such that when adhesive (e.g., epoxy) is inserted into the chambers and then a different one of the bar end portions is thereafter inserted into the adhesive containing chambers, fluid flows through the fluid outlet ports 4, 14. Indeed, the inventive apparatus may be described as including adhesive established in the chamber (s).

Of course, as alluded to throughout this description, a primary, but not exclusive, application of the various inventive technologies is rebar coupling and rebar retention. As such, the bar end portion(s) comprise rebar end portions. It is also of note that in those embodiments with a barrier (e.g., a fluid impervious barrier 8), such barrier may be an integral part of the contiguity (e.g., instead of being screwed or snapped into place, it is, for example, molded concurrently with the molding of the entire contiguity). The contiguity itself may be made from any of a number of materials, a metal such as steel being preferred, but certainly not the only option.

At least one embodiment of the inventive method technology may be described as a bar retention method that comprises the steps of: pressure-free packing adhesive 3 in each bar accommodative chamber 10, 30 of a rigid contiguity; then manually establishing a bar end portion 2 in each the chamber 30 while expelling fluid through a fluid outlet port 4, 14; and then curing, without heat application, the adhesive to achieve a design strength. It is of note that design strength, as used herein, may be governed by applicable code. Further, the term "pressure-free packing adhesive" merely implies placement of adhesive into the chamber without the need to overcome a pressure inside the chamber.

Figure 5A:
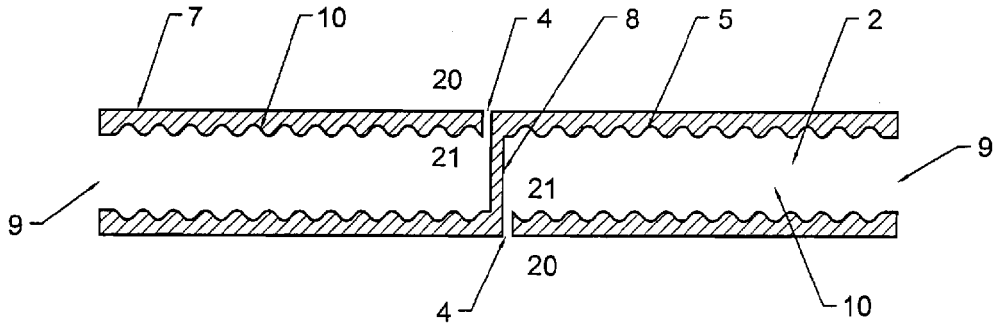
FIG. 5A shows a cross-sectional side view of at least one sleeve embodiment of the inventive technology.
Figure 5B:
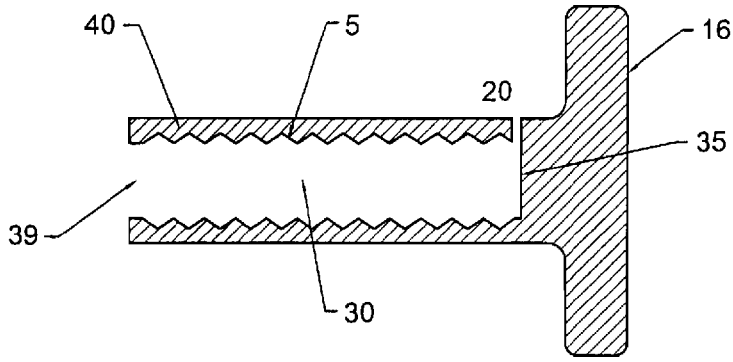
FIG. 5B shows a cross-sectional side view of at least one single bar embodiment of the inventive technology.
Figure 5C:
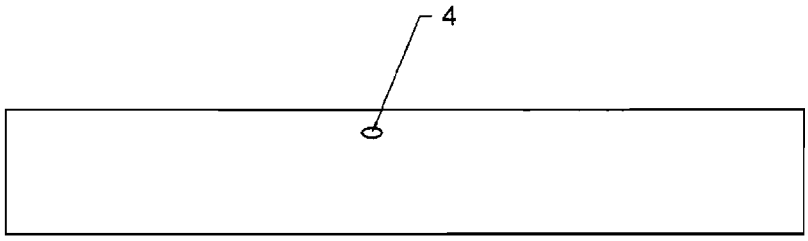
FIG. 5C shows a side view of at least one sleeve embodiment of the inventive technology.
Figure 5D:
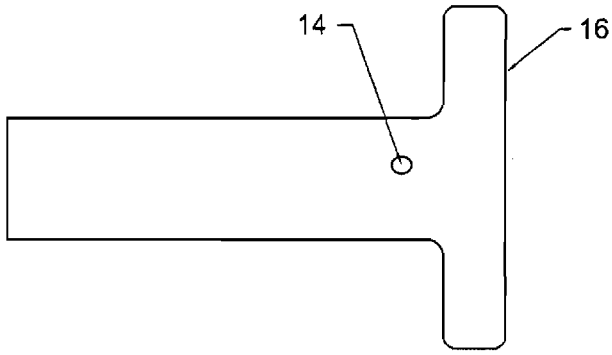
FIG. 5D shows a side view of at least one single bar embodiment of the inventive technology.

In those method embodiments where the rigid contiguity defines only one bar accommodative chamber, the step of pressure-free packing adhesive in each bar accommodative chamber of a rigid contiguity may comprise the step of pressure-free packing adhesive in the only one bar accommodative chamber of the rigid contiguity (see FIG. 5B, e.g.). As in other single chamber embodiments, the rigid contiguity may comprise a flange.

In those method embodiments where the rigid contiguity defines only two bar accommodative chambers, the step of pressure-free packing adhesive in each bar accommodative chamber of a rigid contiguity may comprise the step of pressure-free packing adhesive in the only two bar accommodative chambers of the rigid contiguity (see FIG. 5A, e.g.). Of course, as in other two chamber embodiments, the rigid contiguity may be described as a sleeve. Regardless of the number of chambers, the step of manually expelling fluid may comprise the step of manually expelling adhesive and/or air (e.g., through fluid outlet port(s)).

At least one embodiment of the inventive method technology may be described as a bar retention method that comprises the steps of: pressure-free packing adhesive 3 in each bar accommodative chamber 10, 30 of a rigid contiguity 1, 11; manually establishing a bar end portion 2 in each the chamber; and curing, without heat application, the adhesive to achieve a design strength. In embodiments where the rigid contiguity defines only one bar accommodative chamber, the rigid contiguity may comprise a flange 16; in embodiments where the rigid contiguity defines only two bar accommodative chambers, the rigid contiguity may be a sleeve. Regardless of the number of chambers, the step of expelling fluid (air and/or adhesive) through a fluid outlet port may be performed while performing the step of manually establishing. In certain embodiments, the step of manually establishing is performed after the step of pressure-free packing adhesive.

In any of the method embodiments, it is preferred that the method does not comprise the step of welding or applying heat. Also, in preferred embodiments, whether method or apparatus, end caps (that cap the open end of the chamber(s)), whether integral to the contiguity or not, are not used or needed. Further, in certain embodiments, the step of manually establishing can be performed without contacting walls 22 of each bar accommodative chamber, and each bar accommodative chamber is at least partially defined by interior walls with deformations. Of course, such deformations may be oriented as described elsewhere in this application.

It is of note that in any of the embodiments, specialized equipment (e.g., welder, pressurized adhesive applicators) may not be required (a caulking gun is not considered specialized equipment). Further, preferred embodiments do not require any screwing of any parts, as threads are preferably absent from preferred embodiments. Additionally, it should be clear that the sleeve apparatus may be used to couple a bars of different diameters. In such case, the internal diameter of the chambers may be different (although different, but closely sized rebar might not require such a difference in diameter).

As can be easily understood from the foregoing, the basic concepts of the present invention may be embodied in a variety of ways. It involves both coupling techniques as well as devices to accomplish the appropriate coupling. In this application, the coupling techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling" and even a "means for coupling" Such changes and alternative terms are to be understood to be explicitly included in the description.

Any acts of law, statutes, regulations, or rules mentioned in this application for patent; or patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i)

each of the coupler devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The invention claimed is:

1. A rebar coupling sleeve apparatus comprising:

a rigid contiguity defining a longitudinal axis, and having two ends, an opening at each of said ends and a chamber extending into the contiguity from each opening for reception of an end portion of rebar;

said chambers being defined by interior walls of said rigid contiguity and a fluid impervious barrier established as part of said contiguity to define an end of each of said two chambers within said contiguity, said chambers being fluidically non-communicative with each other;

end portions of rebar established in said two fluidically non-communicative chambers, said rebar having rebar deformations defining a largest rebar outer diameter;

adhesive established between said interior walls of said rigid contiguity and said end portions of said rebar;

two fluid outlet ports, each associated with a different one of said chambers, and each enabling flow of adhesive from its associated chamber to an environment external of said rigid contiguity when the end portions of rebar are inserted into the chambers; and interior wall deformations of said interior walls defined by peaks and valleys, wherein said peaks define a smallest interior wall diameter of said interior walls, said smallest interior wall diameter being larger than said largest rebar outer diameter such that said different end portions of said rebar are capable of being inserted a substantial distance into said two chambers manually, without rotation of said different end portions of said rebar, and are immediately removable from said two chambers manually, without rotation of said different end portions of said rebar.

2. A rebar coupling sleeve apparatus as described in claim 1 wherein said apparatus is configured such that when adhesive is inserted into said chambers and then each of said end portions of said rebar are thereafter inserted into said adhesive containing chambers, some adhesive flows through said fluid outlet ports and remaining adhesive is established between said different end portions of said rebar and said interior walls.

3. A bar coupling sleeve apparatus as described in claim 2 wherein said adhesive is epoxy.

4. A rebar coupling sleeve apparatus as described in claim 1 wherein insertion of adhesive into said chambers, and subsequent insertion of said end portions of said rebar into said chamber, results in a design strength coupling after curing.

5. A rebar coupling sleeve apparatus as described in claim 4 wherein said adhesive is insertable into said chambers without pressure.

6. A rebar coupling sleeve apparatus as described in claim 4 wherein said design strength is achievable without heat application.

7. A rebar coupling sleeve apparatus as described in claim 1 wherein said adhesive alone retains said end portions of said rebar in a different one of said chambers.

8. A rebar coupling sleeve apparatus as described in claim 1 wherein said barrier is an integral part of said contiguity.

9. A rebar coupling sleeve apparatus as described in claim 1 wherein, upon wherein the only material established between said end portions of said rebar and said interior wall deformations is adhesive.

10. A rebar coupling sleeve apparatus as described in claim 1 wherein said interior wall deformations are annular.

11. A rebar coupling sleeve apparatus as described in claim 1 wherein said interior wall deformations are non-threaded.

* * * * *